US005082331A

United States Patent [19]

LeBegue et al.

[11] Patent Number: 5,082,331

[45] Date of Patent: * Jan. 21, 1992

[54] CONTINUOUS MINER WITH DUCT ASSEMBLY

[75] Inventors: Maurice K. LeBegue; Henry E. Wilson, both of Fairmont, W. Va.

[73] Assignee: Tamrock World Corporation, N.V., Curacao, Netherlands Antilles

[ * ] Notice: The portion of the term of this patent subsequent to Jun. 20, 2006 has been disclaimed.

[21] Appl. No.: 502,030

[22] Filed: Mar. 29, 1990

Related U.S. Application Data

[63] Continuation of Ser. No. 325,666, Mar. 20, 1990, Pat. No. 4,936,632, which is a continuation-in-part of Ser. No. 76,155, Jun. 20, 1989, Pat. No. 4,840,432.

[51] Int. Cl.[5] ..... E21C 35/22

[52] U.S. Cl. ..... 299/64; 299/12

[58] Field of Search ..... 299/12, 64–68, 299/76; 98/50

[56] References Cited

U.S. PATENT DOCUMENTS

| | | | |
|---|---|---|---|
| 4,249,778 | 2/1981 | McGuire | 299/12 X |
| 4,289,509 | 9/1981 | Hölter | 299/12 X |
| 4,380,353 | 4/1983 | Campbell et al. | 299/12 |
| 4,463,973 | 8/1984 | Westphal | 299/12 X |

*Primary Examiner*—David J. Bagnell
*Attorney, Agent, or Firm*—S. J. Price, Jr.

[57] ABSTRACT

A self-propelled continuous mining machine includes a mobile frame assembly having a front end portion with a boom assembly pivotally retained thereon. A dust collecting system is positioned on the mobile frame assembly for inducing a flow of air through a hollow interior portion of the boom assembly. As a dislodging head removes material from a mine face, the dust collecting system draws airborne dust created by the dislodging head through a hollow interior of the boom assembly and into the collecting system mounted on the mobile frame assembly. Two portions of the boom assembly are pivotally connected to portions of the collecting system mounted on the mobile frame assembly to provide pivoting joints to allow the collecting system to draw airborne dust through the boom assembly with the boom assembly in any preselected position relative to the mobile frame assembly. Twin ducts of the collecting system meet the boom on each side of the mining machine and the ducts of the collecting system extend rearwardly along each side of the mobile frame assembly. A conveying system mounted on the mobile frame assembly receives material from the dislodging head and transports the material rearwardly of the machine. One of the twin ducts crosses to the other side of the mobile frame by passing between the conveying reach and the return reach of the conveying system and joins with the other duct so that a single fan may be used to draw airborne dust through the system.

5 Claims, 4 Drawing Sheets

CONTINUOUS MINER WITH DUCT ASSEMBLY

CROSS REFERENCE TO RELATED APPLICATIONS

This application is a continuation of application Ser. No. 325,666, filed on Mar. 20, 1990, entitled "Continuous Miner With Duct Assembly", now U.S. Pat. No. 4,936,632, a continuation in part of application Ser. No. 076,155 filed on June 20, 1989 entitled "Continuous Miner With Duct Assembly", now U.S. Pat. No. 4,840,432.

BACKGROUND OF THE INVENTION

1. Field Of The Invention

This invention relates to a mining machine, and more particularly, to a continuous miner which includes a mobile frame assembly and a boom assembly pivotally secured to the mobile frame assembly by a plurality of connectors which distribute the load placed on the boom assembly as the boom assembly is pivoted upwardly from the mobile frame assembly evenly throughout the boom structure, and to a dust collecting system for collecting airborne particles produced as a material dislodging head mounted on the end of the boom assembly dislodges material from a mine face.

2. Description Of The Prior Art

In underground mining, it is well known to provide a continuous mining machine which includes a material dislodging head positioned on the front end of the mining machine for dislodging material from a mine face. The dislodged material is conveyed rearwardly of the mining machine by a conveying system positioned on the continuous mining machine. The continuous mining is designed to continuously advance and dislodge material being mined to form an entry or tunnel in the material seam.

Various types of continuous mining machines having different types of tilting of pivoting mining heads are known. U.S. Pat. No. 2,986,384 discloses a mining machine having tiltable, dual mining heads. U.S. Pat. Nos. 3,479,090 and 3,495,876 disclose continuous mining machines each having a pivoting structure for supporting a mining head.

U.S. Pat. No. 3,498,676 discloses a continuous mining machine having a mining head that is positioned at the top of the mine face. The mining head is advanced into the mine face and traversed downwardly through the mine face to cut and break the material out of the mine face. The mining machine is supported on traction treads by which the machine is propelled forwardly to advance the mining head into the mine face.

U.S. Pat. No. 3,499,684 discloses a mining machine with a mining head positioned at the forward end of the machine. Traction means propels the mining machine, and gathering means collects the mined material and transfers the material to a conveyor for moving the mined material to the rear of the machine. The mining head is positioned on a boom that is movable upwardly and downwardly about the transverse axis of a pivot support on the machine main frame.

U.S. Pat. No. 3,516,712 discloses a continuous mining machine with a transverse rotary mining head for mining material from the entire area of the mine face by traversing the mining head through the mine face.

U.S. Pat. No. 3,874,735 discloses a continuous mining machine adapted for low overhead coal seams having a relatively small diameter cutter head of the non-oscillating or fixed head type driven by chains that also cut coal and convey it rearwardly to a gathering head mounted on the front of the machine. The gathering head carries a pair of counter-rotating discs having veins cooperating with conveyor fences for sweeping and discharging coal to a conventional conveyor mounted on the machine chassis.

U.S. Pat. No. 3,966,258 discloses a mining machine having a disintegrating head carried on the front end of the machine by a pivotal link arrangement.

In continuous underground mining, it is also known to provide a mining machine which includes a dust collecting system mounted thereon for collecting airborne dust particles produced as the mining machine cutting or dislodging head operates. The dust collecting system provides a relatively clean environment for the mining machine operator.

U.S. Pat. No. 3,712,678 discloses a continuous miner which is provided with a dust collecting system comprising boom-carried ducting adapted to receive dust-entrained air adjacent and rearwardly of the mining head. The mining machine chassis carries ducting which is operable to alternatively discharge the air to opposite sides of the machine. Counter-rotating centrifugal fans mounted in the boom-carried ducting draw dust-entrained air to such ducting whereby the air flows therethrough to the chassis-carried ducting. Scrubbers or cleaners are operatively associated with the boom-carried ducting for removing larger dust particles from the air.

U.S. Pat. No. 3,810,677 discloses a mining machine having a boom enclosed dust collector assembly for use in a coal mining operation wherein the dusty air from a mining operation is gathered directly from the operation, collected in the mining machine boom and selectively wetted and separated by centrifugal processing into a coal slurry for disposal. The clean air is exhausted to atmosphere. The coal slurry is discharged from the mining machine boom through a flexible hose which lies on the ground along a side of the machine.

U.S. Pat. No. 4,380,353 discloses a dust control system for a mining machine comprising a ductwork system having intakes adjacent the cutter head of the mining machine. A fan draws air through the ductwork system, and a flooded bed scrubber in the ductwork system upstream from the fan entrains the dust in droplets of water. The dust laden water is pumped to a point adjacent the cutting head.

U.S. Pat. No. 4,557,524 discloses a continuous mining machine having a dust control system which includes a generally rectangular intake duct section associated with the boom and a generally rectangular fixed duct section mounted on the vehicle. A transition section is connected to the intake of the fixed duct section. The transition section consists of a two piece arrangement wherein each piece is hinged to the intake duct section and is capable of slidingly engaging the fixed duct section at the end thereof adjacent the boom to sealingly couple the intake duct section to the fixed duct section as the boom swings upwardly and downwardly.

Although the prior art continuous mining machines include various types of cutting heads pivotally mounted on the mining machine, there is a need for an improved mining machine having a boom assembly pivotally connected to the mining machine frame assembly by a plurality of connectors which distribute the load on the mining machine boom assembly as it is pivoted upwardly from the mining machine frame assembly evenly throughout the boom assembly structure. Further, there is a need for a simple, efficient dust collecting system whereby dust produced as a dislodging head dislodges material from a mine face is passed through a boom assembly hollow interior portion to a dust collecting system mounted on the mining machine frame. A portion of the boom assembly forms a pivoting joint with a portion of the dust collecting system positioned on the mobile frame assembly to allow airborne dust particles to be withdrawn from the mine face as the boom assembly pivots upwardly and downwardly relative to the mobile frame assembly.

In another embodiment of the invention, two portions of the boom assembly form pivoting joints with portions of the dust collecting system positioned on each side of the mobile frame assembly to allow airborne dust particles to be withdrawn from the mine face as the boom assembly pivots upwardly and downwardly relative to the mobile frame assembly.

Twin ducts of the collecting system meet the boom on each side of the mining machine and extend rearwardly along each side of the mobile frame assembly. One of the twin ducts passes between the conveying reach and the return reach of the conveying system to join with the other duct to allow a single fan to withdraw airborne dust particles from the mine face.

SUMMARY OF THE INVENTION

In accordance with the present invention, there is provided a continuous mining machine for use in an underground mine which includes a mobile frame assembly and a boom assembly extending from the mobile frame assembly. The boom assembly has a first end portion pivotally connected to the mobile frame assembly by a plurality of connecting means and a second end portion spaced from the first end portion. The boom assembly first end portion is pivotally connected to the mobile frame assembly to permit upward and downward pivotal movement of the boom assembly relative to the mobile frame assembly. A material dislodging head is connected to the boom assembly second end portion. The plurality of connecting means are positioned on the boom assembly to distribute the load placed on the boom assembly as it is pivoted upwardly from the mobile frame assembly evenly through the boom assembly structure.

In one embodiment of the invention, the boom assembly has a hollow interior portion with an air inlet portion connected to the hollow interior portion at each boom assembly second end portion and an air outlet portion at the boom assembly first end portion. A collecting means is positioned on the mobile frame assembly. The collecting means induces a flow of air through the boom assembly hollow interior portion. As the dislodging head operates to dislodge material from a mine face, the collecting means draws airborne dust produced by the dislodging head through the hollow interior portion of the boom assembly into the collecting means positioned on the mobile frame assembly. A portion of the boom assembly air outlet portion is pivotally connected to a portion of the mobile frame assembly collecting means to allow the collecting means to continually draw airborne dust from the mine face as the boom assembly pivots upwardly and downwardly relative to the mobile frame assembly.

In another embodiment of the invention, the boom assembly has a hollow interior portion with inlet portions connected to the hollow interior portion at each boom assembly second end portion and air outlet portion at the boom assembly first end portion. A collecting means is positioned on the mobile frame assembly. The collecting means induces a flow of air through the boom assembly hollow interior portion. As the dislodging head operates to dislodge material from a mine face, the collecting means draws airborne dust produced by the dislodging head through the hollow interior portion of the boom assembly into the collecting means positioned on the mobile frame assembly. Two portions of the boom assembly air outlet portions are pivotally connected to portions of the mobile frame assembly collecting means to allow the collecting means to continually draw airborne dust from the mine face as the boom assembly pivots upwardly and downwardly relative to the mobile frame assembly. Twin ducts of the collecting system meet the boom assembly on each side of the mining machine and the ducts of the collecting system extend rearwardly along each side of the mobile frame assembly. The first duct assembly extends longitudinally along the first side of the mobile frame assembly. The second duct assembly extends longitudinally along part of the second side of the mobile frame. The second duct assembly then traverses the mobile frame by means of a cross-over portion that passes between the conveying reach and the return reach of a conveying means to join with the first duct assembly. Each duct assembly opposite end portion is in fluid communication with the boom assembly hollow interior portions in all positions that the boom assembly pivots upwardly and downwardly so that a single fan may be used to draw airborne dust through the system.

The continuous mining machine further includes the conveying system which extends longitudinally through the center of the mining machine. The conveying system includes a longitudinal first section which extends from the front end of the mobile frame assembly to the rear end of the mobile frame assembly. The conveying system also includes a conveyor second section pivotally connected to the conveyor first section which extends rearwardly from the rear end of the mobile frame assembly. The conveyor second section is pivotally connected to the conveyor first section for selected lateral and vertical movement relative to the conveyor first section. Material removed from the mine face by the dislodging head is transferred rearwardly of the mining machine along the conveyor system first and second sections by a plurality of spaced flights. The conveyor second section is pivoted relative to the conveyor first section to deposit dislodged material at predetermined locations rearwardly of the mining machine.

Accordingly, the principal object of the present invention is to provide a continuous mining machine which includes a boom assembly pivotally connected to the mining machine mobile frame assembly by a plurality of connecting means.

Another object of the present invention is to provide a continuous mining machine having a boom assembly pivotally connected to a mobile frame assembly by a plurality of connecting means suitably positioned on the boom assembly to distribute the loading created on the boom assembly as the boom assembly is pivoted upwardly relative to the mobile frame assembly evenly throughout the boom assembly structure.

A further object of the present invention is to provide a continuous mining machine which includes a dust collecting system positioned on the mobile frame assembly for inducing a flow of air through a hollow interior portion of the boom assembly as the boom assembly pivots upwardly and downwardly relative to the mobile frame assembly.

A further object of the present invention in one of its embodiments is to provide a continuous mining machine which includes a dust collecting system with one fan and twin ducts positioned on the mobile frame assembly for inducing a flow of air through two hollow interior portions of the boom assembly as the boom assembly pivots upwardly and downwardly relative to the mobile frame assembly.

Still another object of the present invention is to provide a continuous mining machine which includes a conveying system longitudinally positioned on the mobile frame assembly to receive material dislodged from a mine face by a dislodging head and transfer the dislodged material rearwardly from the mine face.

These and other objects of the present invention will be more completely disclosed and described in the following specification, the accompanying drawings and the appended claims.

DESCRIPTION OF THE PREFERRED EMBODIMENTS

Figures 1, 2:
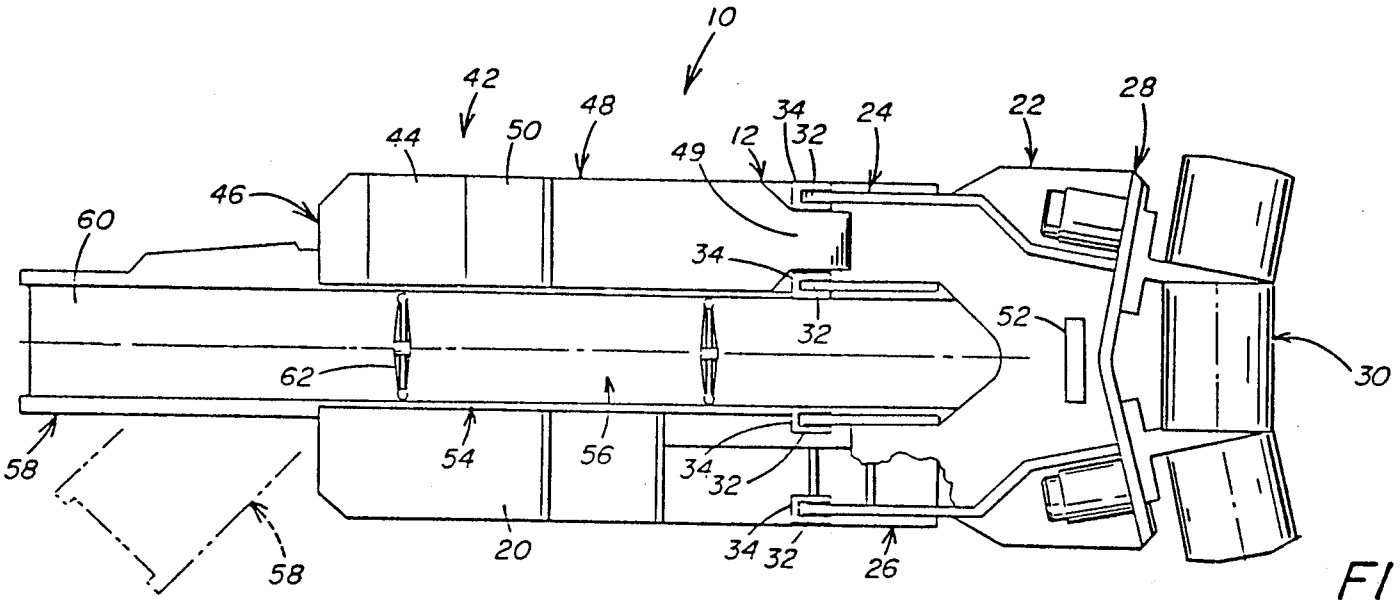
FIG. 1 is a top plan view of one embodiment of a self-propelled continuous mining machine which is the subject of this invention.
FIG. 2 is a view in side elevation of the continuous mining machine shown in FIG. 1, illustrating a boom assembly having a dislodging head secured thereto resting on a mine floor, and illustrating in phantom the boom assembly pivoted upwardly relative to the mining machine to show the extent of travel of the boom assembly.

Referring to the drawings, and particularly to FIGS. 1, 2, 5, and 6, there is illustrated a continuous mining machine generally designated by the numeral 10 for use in an underground mine to dislodge material from a mine face. Continuous mining machine 10 includes a mobile frame assembly 12 and a pair of ground engaging traction means 14 (one shown in FIGS. 2 and 6) positioned at each side of mobile frame assembly 12 for propelling mining machine 10 within a mine 16 along the floor 18 thereof.

Continuous mining machine 10 is capable of being operated from an operating station 20 in a manner similar to other such machines to dislodge material from a mine face 36 and transport it rearwardly of the rear end 46 of mining machine 10. Accordingly, mining machine 10 includes operating controls and sources of power for operating ground engaging traction means 14 and other equipment included thereon.

Mining machine 10 includes a boom assembly 22 having a first end section 24 pivotally secured to the front end 26 of mobile frame assembly 12. Boom assembly 22 also includes a second end section 28. As seen in FIGS. 1, 2, 5, and 6, a material dislodging head generally designated by the numeral 30 is connected to boom assembly 22 second end section 28. Although a material dislodging head such as dislodging head 30 is illustrated in the figures, it should be understood that any desired dislodging head 30 known in the art may be secured to boom assembly 22 second end section 28.

Boom assembly 22 also includes four longitudinally extending engaging plates 32 which extend rearwardly from boom assembly 22 first end section 24 to engage four generally U-shaped retainers 34 secured to the front end 26 of mobile frame assembly 12. Boom assembly 22 engaging plates 32 are pivotally secured to the mobile frame assembly 12 generally U-shaped retainers 34 to allow boom assembly 22 to be pivoted upwardly and downwardly relative to mobile frame assembly 12. In this manner, as boom assembly 22 is pivoted upwardly and downwardly relative to mobile frame assembly 12, dislodging head 30 may be operated to dislodge material from a face 36 of the mine 16.

Figure 6:
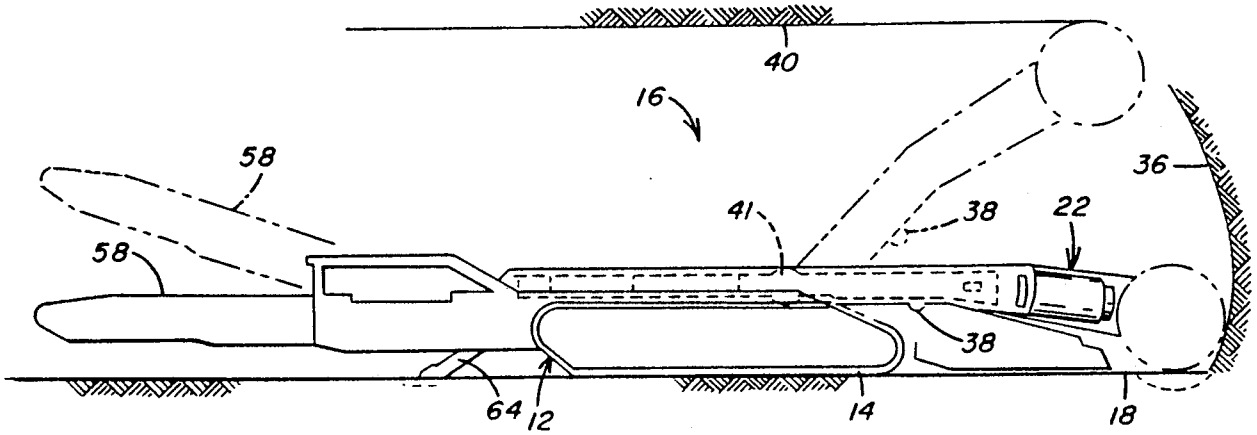
FIG. 6 is a view in side elevation of the continuous mining machine shown in FIG. 5, illustrating a boom assembly having a dislodging head secured thereto adjacent the mine floor, and illustrating in phantom the boom assembly pivoted upwardly relative to the mining machine to show the extent of travel of the boom assembly.

Although not specifically illustrated in the figures, actuating cylinders, preferably hydraulic cylinders, are connected at one end to front end 26 of mobile frame assembly 12. The other ends of the actuating cylinders are connected to retainers 38 (one shown in FIGS. 4 and 8) on boom assembly 22. As the actuating cylinders extensible rod portions are extended outwardly from their respective cylinder bodies, boom assembly 22 pivots vertically relative to mobile frame assembly 12 to allow dislodging head 30 to dislodge material from the full vertical surface of mine face 36. As seen in FIGS. 2 and 6, since boom assembly 22 is pivotally connected to mobile frame assembly 12, boom assembly 22 travels in an arcuate path between mine floor 18 and mine roof 40 as dislodging head 30 dislodges material from mine face 36. As also seen in FIGS. 2 and 6, boom assembly 22 is capable of downward arcuate movement to allow dislodging head 30 to travel below the surface of mine floor 18.

As illustrated in phantom in FIGS. 2 and 6, since boom assembly 22 is pivotally secured to mobile frame assembly 12, boom assembly 22 travels in an arcuate path from a point beneath mine floor 18 to mine roof 40. As boom assembly 22 pivots upwardly towards mine roof 40, the weight of boom assembly 22 and dislodging head 30 creates torsional loading on the four pivot pins (shown in FIGS. 3 and 7) which secure boom assembly 22 engaging plates 32 to mobile frame assembly 12 generally U-shaped retainers 34. However, since boom assembly 22 is pivotally connected to mobile frame assembly 12 by four engaging plates 32, this four point connection allows the torsional loading created as boom assembly 22 and dislodging head 30 are pivoted upwardly towards mine roof 40 to be evenly spread through boom assembly 22. This four point connection reduces the wear on the pivot pins and provides a sturdy connection between boom assembly 22 and mobile frame assembly 12.

In the embodiment of FIGS. 1-4, mining machine 10 also includes a dust collecting system generally designated by the numeral 42. Dust collecting system 42 is operable to remove airborne particles produced as dislodging head 30 dislodges material from mine face 36 to provide a clean working environment for the mining machine 10 operator. Dust collecting system 42 includes a fan assembly 44 mounted on mobile frame assembly 12 at the rear end 46 of mining machine 10. Dust collector 50 is also positioned on mobile frame assembly 12 and is connected to fan assembly 44. Duct assembly 48, which runs longitudinally along mobile frame assembly 12, has an end portion connected to a dust collector 50 and an opposite end portion which extends between a pair of generally U-shaped retainers 34 on mobile frame assembly 12. As will be explained later, duct assembly 48 includes a top wall 49 and a bottom wall 51 each having formed, arcuate end sections. As will also be explained later and illustrated in FIG. 4, boom assembly 22 includes a hollow interior portion 78 and an air inlet 52 which form part of dust collecting system 42. A portion of boom assembly 22 forms a pivoting joint with the formed, arcuate end sections of duct assembly 48 top wall 49 and bottom wall 51.

As dislodging head 30 operates to dislodge material from mine face 36, fan assembly 44 draws airborne dust produced by dislodging head 30 into boom assembly 22 air inlet portion 52 and through the hollow interior 78 of boom assembly 22 into duct assembly 48 positioned on mobile frame assembly 12. The dust which passes through duct assembly 48 is collected in dust collector 50. Dust collecting system 42 withdraws airborne dust from the area adjacent mine face 36 for the safety of the mining machine 10 operator. The pivoting point formed duct assembly 48 and boom assembly 22 allows collecting system 42 to draw airborne dust away from mine face 36 as boom assembly 22 is pivoted upwardly and downwardly on mobile frame assembly 12.

In the embodiment of FIGS. 5-10, mining machine 10 includes a dust collecting system also generally designated by the numeral 42. Dust collecting system 42 is operable to remove airborne particles produced as dislodging head 30 dislodges material from mine face 36 to provide a clean working environment for the mining machine 10 operator. Dust collecting system 42 includes a fan assembly 44 mounted on mobile frame 12 at the rear end 46 of mine machine 10. A dust collector 50 is also positioned on mobile frame assembly 12 and is connected to fan assembly 44. A duct assembly generally designated by the numeral 48 includes first duct assembly 47, which runs longitudinally along mobile frame assembly 12, has an end portion connected to a dust collector 50 and an opposite end portion which extends between a pair of generally U-shaped retainers 34 on mobile frame assembly 12 and includes second duct assembly 90. On the opposite side of mobile frame 12 from first duct assembly 47 the second duct assembly 90 runs longitudinally partially along mobile frame assembly 12 to a traverse cross-over portion 92 extending between the conveying reach 59 and the return reach 61 (shown in FIG. 10) of conveyor deck 60 where the end portion 94 of second duct assembly 90 interconnects with first duct assembly 48.

As will be explained later in greater detail, first duct assembly 48 and second duct assembly 90 each include a top wall 49 having formed, arcuate end section 85 and a bottom wall 51 having a formed, arcuate end section 87 that are connected to a pair of vertically extending side walls 91 (shown in FIG. 9). As will be explained later in greater detail and illustrated in FIG. 8, boom assembly 22 includes a hollow interior portion 78 and an air inlet 52 which forms a part of dust collecting system 42. Two portions of boom assembly 22 form sliding joints 41 with the formed, arcuate end sections 85, 87 of first duct assembly 48 top wall 49 and bottom wall 51 and with the formed, arcuate end sections 85, 87 of second duct assembly 90 top wall 49 and bottom wall 51. This allows airborne dust to pass between joint space 89 located between the ends of formed, arcuate end section 85 and the formed, arcuate end section 87.

As dislodging head 30 operates to dislodge material from mine face 36, fan assembly 44 draws airborne dust produced by dislodging head 30 into boom assembly 22 air inlet portion 52 and through the hollow interior 78 of boom assembly 22 into first duct assembly 47 and second duct assembly 90 positioned on opposite ends of mobile frame assembly 12. The dust which passes through first duct assembly 47 is collected in dust collector 50. The dust which passes through second duct assembly 90 then passes through cross-over portion 92 to end portion 94 and therethrough to first duct assembly 48 where the duct is collected in dust collector 50. As described, dust collecting system 42 withdraws airborne dust from the area adjacent mine face 36 for the safety of the mining machine 10 operator. Sliding joints 41 formed from first duct assembly 47 and boom assembly 22 and from second duct assembly 90 and boom assembly 22 allow collecting system 42 to draw airborne dust away from mine face 36 as boom assembly 22 is pivoted upwardly and downwardly on mobile frame assembly 12.

In both embodiments of the invention, mining machine 10 also includes a conveyor system generally designated by the numeral 54. Conveyor system 54 extends longitudinally from the front end 26 of mobile frame assembly 12 to a location rearwardly of the rear end 46 of mobile frame assembly 12. Conveyor system 54 includes a conveyor first section 56 which extends longitudinally through the center of mobile frame assembly 12. Conveyor system 54 also includes a conveyor second section 58 which extends rearwardly to the rear end 46 of the mobile frame assembly 12 and is pivotally connected to the conveyor first section 56 for lateral movement relative to conveyor first section 56. In this manner, conveyor second section 58 can be suitably positioned to deposit material provided to conveyor system 54 by dislodging head 30 at a preselected location rearwardly of rear end 46 of mining machine 10. Further, as illustrated in phantom in FIGS. 2 and 6, conveyor second section 58 may be inclined to conveyor first section 56 if it is desired to deposit the dislodged material into a receiver. Conveyor first and second sections 56, 58 include a common conveyor deck 60 having track 107 which rotates by conventional means over a conveying reach 59 above and a return reach 61 below common conveyor deck 60. A plurality of spaced flights 62 transports material dislodged by dislodging head 30 over conveying reach 59 rearwardly of the rear end 46 of mining machine 10 along the common conveyor deck 60 of conveyor first section 56 and conveyor second section 58.

As seen in FIGS. 2 and 6, mining machine 10 also includes a stabilizer 64 which is pivotally connected to mobile frame assembly 12. Before mining machine 10 commences operation to dislodge material for mine face 36, stabilizer 64 is extended downwardly to contact mine floor 18. As boom assembly 22 and dislodging head 30 are pivoted vertically relative to mobile frame assembly 12 to dislodge material from mine face 36, stabilizer 64 operates to stabilize the rear end 46 of mining machine 10 to prevent vertical movement of the rear end 46 of mining machine 10.

Referring to FIGS. 3, 4, 7, and 8, there is illustrated boom assembly 22 previously described. Boom assembly 22 includes a generally transverse front wall 66 and a pair of generally longitudinally extending outer side walls 68 connected to a transverse front wall 66. Generally longitudinally extending outer side walls 68 each include a bent portion 69 which provides clearance for dislodging head 30 drive motors 71.

Boom assembly 22 also includes a horizontally extending top wall 72 and a horizontally extending bottom wall 74. Horizontally extending top wall 72 and horizontally extending bottom wall 74 are connected between the generally longitudinally extending outer side walls 68. Horizontally extending top and bottom wall 72, 74 are also connected to transverse front wall 66.

Figure 3:
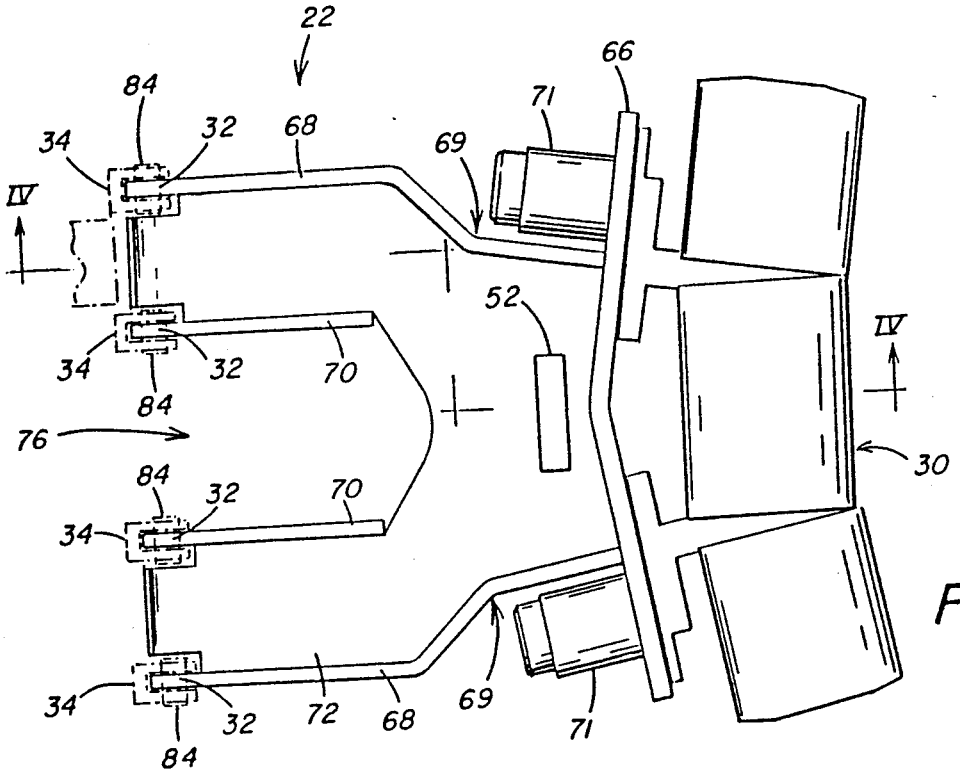
FIG. 3 is a top plan view of one embodiment of a boom assembly, illustrating in phantom the boom assembly connections to the mining machine.
Figure 7:
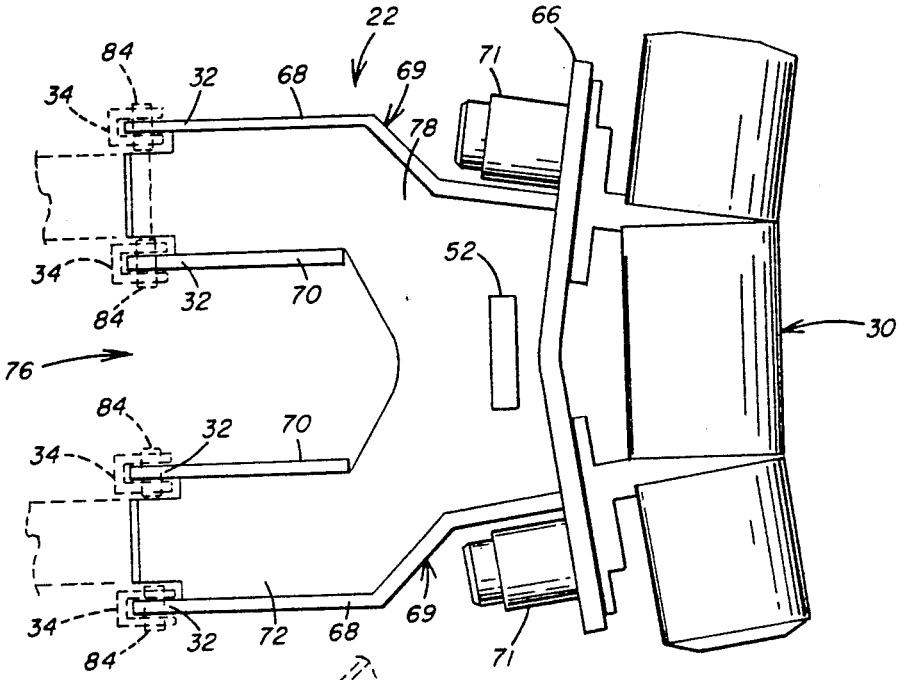
FIG. 7 is a top plan view of a second embodiment of a boom assembly, illustrating in phantom the boom assembly connections to each side of the mobile frame assembly of the mining machine.

As seen in FIGS. 3 and 7, horizontally extending top wall 72 and horizontally extending bottom wall 74 each include a generally U-shaped cutout 76. The generally U-shaped cutouts 76 and horizontally extending top wall 72 and horizontally extending bottom wall 74 provide clearance for conveyor first section 56 which passes longitudinally through the center of mobile frame assembly 12.

A pair of longitudinally extending inner side walls 70 are connected between horizontally extending top wall 72 and horizontally extending bottom wall 74 as shown in FIGS. 3 and 7. As seen, the arrangement of generally longitudinally extending outer side walls 68, longitudinally extending inner side walls 70, transverse front wall 66 and horizontally extending top and bottom walls 72, 74 provide boom assembly 22 with the hollow interior 78 previously described.

As seen in FIGS. 3 and 7, the pair of generally longitudinally extending outer side walls 68 include a pair of outer side wall plates 32 arranged to be received by a pair of generally U-shaped retainers 34 secured on mobile frame assembly 12 and illustrated in phantom. Similarly, the pair of longitudinally extending inner side walls 70 include a pair of inner side wall plates 32 arranged to be received by another pair of generally U-shaped retainers 34 secured on mobile frame assembly 12 and illustrated in phantom. Outer side wall plates 32 and inner side wall plates 32 represent the engaging plates 32 previously described.

Outer side wall plates of engaging plates 32, inner side wall plates of engaging plates 32 and the four generally U-shaped retainers 34 each include aligned holes to receive four pivot pins 84. As earlier described, boom assembly 22 pivots upwardly and downwardly about pivot pins 84 as the actuating means (not shown) operates to raise and lower boom assembly 22 relative to mobile frame assembly 12. This four pivot pin arrangement evenly distributes the torsional loading placed on boom assembly 22 as boom assembly 22 and dislodging head 30 are pivoted upwardly relative to mobile frame assembly 12. Since the torsional loading is evenly distributed throughout the four pivot pins 84, frictional wearing on each pivot pin 84 is reduced, and the frictional wearing on the pivot pin receiving holes in outer side wall plates of engaging plates 32 and inner side wall plates of engaging plates 32 is also reduced.

Figure 4:
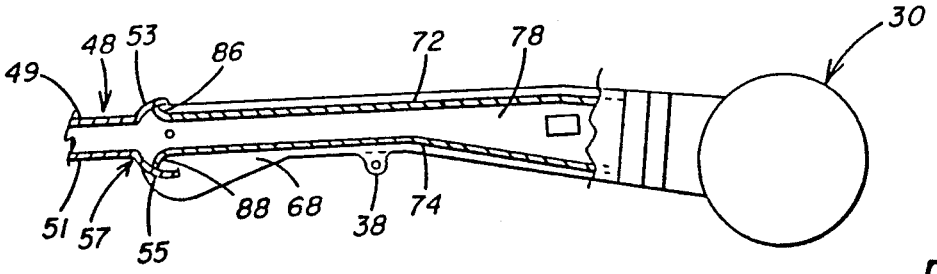
FIG. 4 is a partial fragmentary view in side elevation of the boom assembly shown in FIG. 3, illustrating a pivoting joint connection which is the subject of this invention.

In one embodiment of the invention, referring to FIG. 4, there is illustrated the pivoting joint previously described. The pivoting joint is generally designated by the numeral 57. Horizontally extending top wall 72 and horizontally extending bottom wall 74 include formed, arcuate ends 86, 88, respectively, positioned between a pair of generally U-shaped retainers 34 illustrated in FIG. 3.

As earlier described, collecting system 42 duct assembly 48 includes duct top wall 49 and duct bottom wall 51 having formed, arcuate ends 53, 55, respectively. As seen in FIG. 4, horizontally extending top wall 72 and horizontally extending bottom wall 74 arcuate ends 86, 88 contact the inner surfaces of arcuate ends 53, 55 of each duct top wall 49 and each duct bottom wall 51, respectively, to form pivoting joint 57 between boom assembly 22 and duct assembly 48.

As boom assembly 22 is pivoted upwardly or downwardly relative to mobile frame assembly 12, arcuate ends 86, 88 pivotally contact the inner surfaces of duct assembly 48 arcuate ends 53, 55 to provide pivoting joint 57. In this manner, as fan assembly 44 operates to draw airborne dust produced by dislodging head 30 through air inlet 52 and boom assembly 22 hollow interior 78, the dust passes through pivoting joint 57 formed by arcuate ends 86, 88 and arcuate ends 53, 55 into duct assembly 48. As boom assembly 22 is raised and lowered relative to mobile frame assembly 12 to allow dislodging head 30 to remove material from the full vertical surface of mine face 36, the dust produced by dislodging head 30 is passed through the hollow interior 78 of boom assembly 22 into duct assembly 48 by means of pivoting joint 57. As seen, collecting system 42 can operate to withdraw airborne dust from mine face 36 regardless of the position of boom assembly 22 relative to mobile frame assembly 12. As described, the pivoting joint 57 formed by arcuate ends 86, 88 and arcuate ends 53, 55 eliminates the need for flexible or telescoping duct connections between duct assembly 48 and boom assembly 22.

Figure 8:
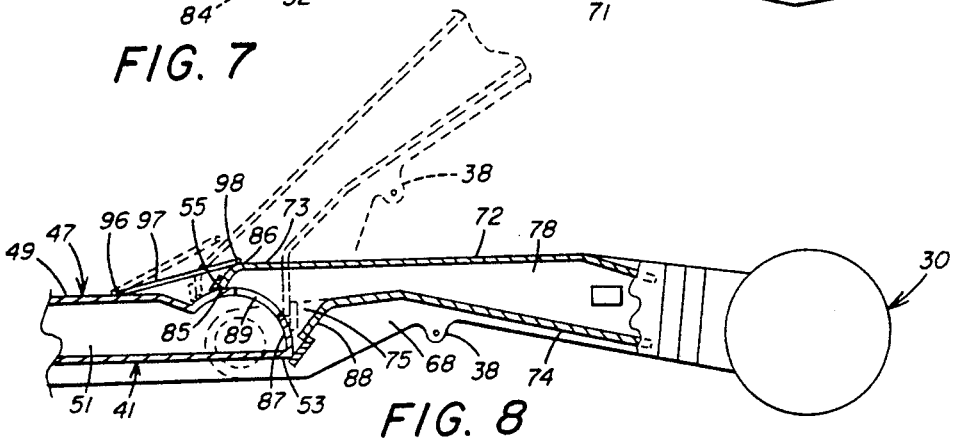
FIG. 8 is a partial fragmentary view in side elevation of the boom assembly shown in FIG. 7, illustrating a pivoting joint connection which is the subject of this invention, and illustrating in phantom the boom assembly pivoted upwardly relative to the mining machine to show the operation of the pivoting joint connection.

In a second embodiment of the invention, referring to FIG. 8, there is illustrated the sliding joint previously described. The sliding joint is generally designated by the numeral 41. Horizontally extending top wall 72 and horizontally extending bottom wall 74 include formed, arcuate ends 73, 75, respectively, positioned between a pair of generally U-shaped retainers 34 illustrated in FIG. 7.

As earlier described, collecting system 42 first duct assembly 47 and second duct assembly 90 each include duct top wall 49 and duct bottom wall 51 having formed, arcuate ends 85, 87, respectively. As seen in FIG. 8, horizontally extending top wall 72 and horizontally extending bottom wall 74 arcuate ends 73, 75 contact the inner surfaces of arcuate ends 85, 87 of each duct top wall 49 in each duct bottom wall 51, respectively, to form sliding joint 41 between boom assembly 22 and first duct assembly 47 and between boom assembly 22 and second duct assembly 90. As shown, arcuate ends 85, 87 do not interconnect leaving joint space 89 to allow for the passage of airborne dust between the hollow interior 78 of boom assembly 22 and mobile frame assembly 12 first duct assembly 47 and second duct assembly 90.

As boom assembly 22 is pivoted upwardly or downwardly relative to the mobile frame assembly 12, arcuate ends 73, 75 slidingly contact the inner surfaces of first duct assembly 47 and second duct assembly 90 arcuate ends 85, 87 to provide sliding joint 41. In this manner, as fan assembly 44 operates to draw airborne dust produced by dislodging head 30 through air inlet 52 and boom assembly 22 hollow interior 78, the dust passes through joint space 89 of sliding joint 41 formed by arcuate ends 73, 75 and arcuate ends 85, 87 into first duct assembly 47 and second duct assembly 90. As boom assembly 22 is raised and lowered relative to mobile frame assembly 12 to another dislodging head 30 to remove material from the full vertical surface of mine face 36, the dust produced by dislodging head 30 is passed through the hollow interior 78 of boom assembly 22 into first duct assembly 47 and second duct assembly 90 through joint space 89 by means of sliding joint 41. As seen, collecting face 42 can operate to withdraw airborne dust from mine face 36 regardless of the position of boom assembly 22 relative to mobile frame assembly 12. As described, the sliding joint 41 formed by arcuate ends 73, 75 and arcuate ends 85, 87 eliminate the need for flexible or telescoping duct connections between boom assembly 22 and between first duct assembly 47 and second duct assembly 90, respectively.

There is also retaining wall 97 which is pivotally fastened by conventional means to mobile frame assembly 12 by mobile frame assembly fastener 96 and to boom assembly 22 by boom assembly fastener 98. Retaining wall 97 pivotally moves in an arcuate direction as boom assembly 22 is moved upwardly and downwardly and provides extra support to the connection between boom assembly 22 and mobile frame assembly 12.

Figure 5:
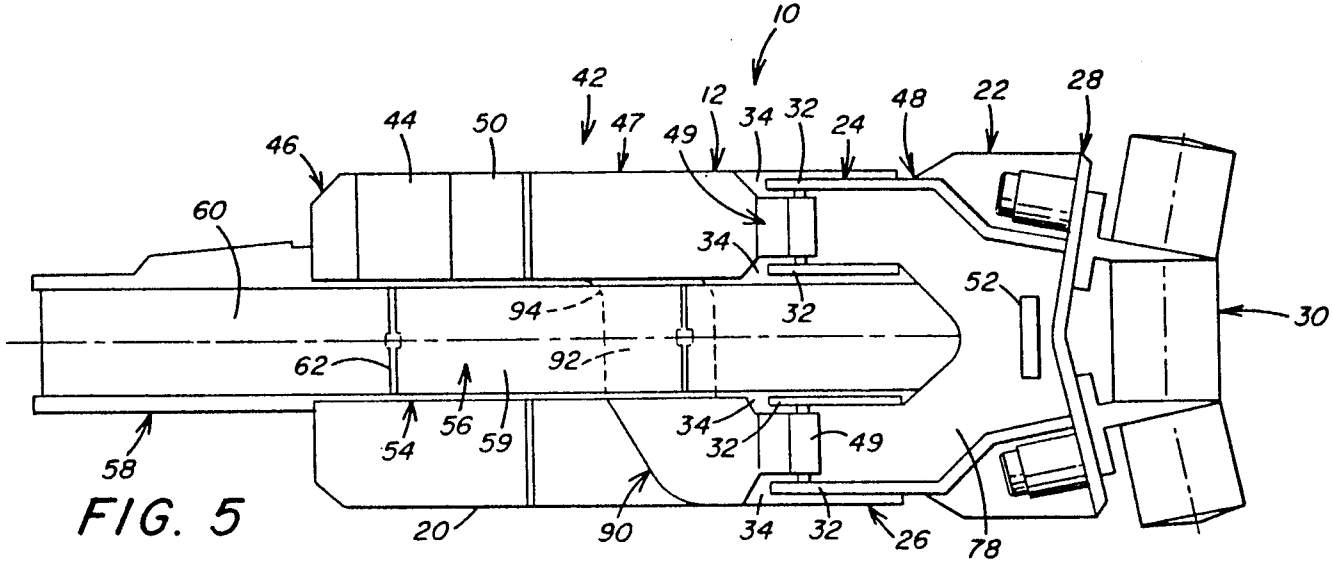
FIG. 5 is a top plan view of a second embodiment of a self-propelled continuous mining machine which is the subject of this invention.

As described previously, second duct assembly 90 traverse cross-over portion 92 passes between conveying reach 59 and return reach 61 of conveyor first section 56 to end portion 94 where it connects with first duct assembly 47. Portions of both interior walls of mobile frame assembly 12 are cut open (as shown in FIG. 5) to receive cross-over portion 92 of second duct assembly 90.

Figure 9:
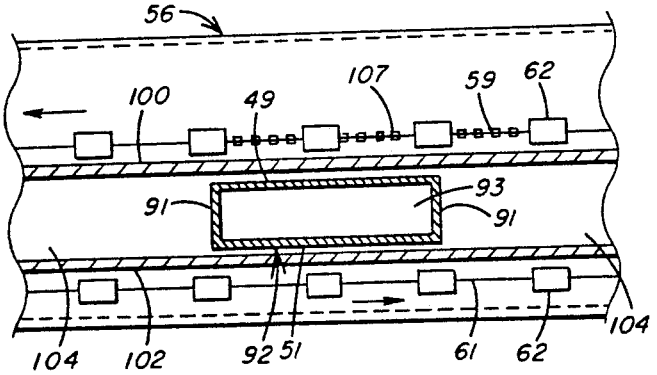
FIG. 9 is a fragmentary cross section of the conveying system showing the cross-over portion of the second duct assembly passing between the conveying reach and the return reach of the conveying system.

Referring to FIG. 9, there is illustrated a fragmentary cross section of conveyor first section 56 and traverse cross-over portion 92 of second duct assembly 90. Conveyor first section 56 includes conveying reach 59 with bottom portion 100 positioned above return reach 61 with top portion 102 with hollow conveyor interior of first section 104 positioned therebetween. Cross-over portion 92 of second duct assembly 90 is positioned in hollow conveyor interior 104 between bottom portion 100 of conveying reach 59 and top portion 102 of return reach 61. Cross-over portion 92 of second duct assembly 90 includes a horizontal top wall 49 and a horizontal bottom wall 51. Horizontally extending top wall 49 and horizontally extending bottom wall 51 are connected between the vertically extending side walls 91 to provide for a hollow cavity 93 surrounded by top wall 49, bottom wall 51 and side walls 91. This hollow cavity facilitates the withdrawal of airborne dust from mine face 36 to dust collector 50.

Figure 10:
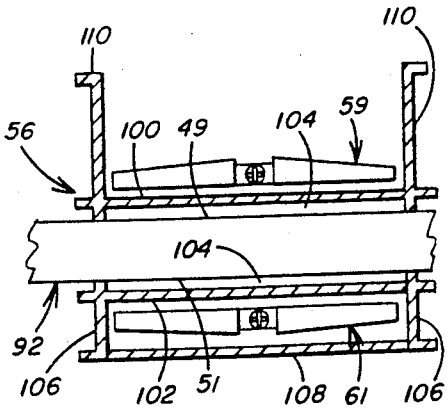
FIG. 10 is a fragmentary sectional view taken along line X—X of FIG. 9 showing a portion of the cross-over duct.

Referring to FIG. 10, a transverse cross section of cross-over portion 92 of second duct assembly 90 and conveyor first section 56 is taken along line X—X of FIG. 9. Return reach 61 includes horizontal top portion 102 and horizontal bottom portion 108 which encloses the track 107 and spaced flights 62 of return reach 61. Horizontal top portion 102 and horizontal bottom portion 108 of return reach 61 are connected to vertically extending side walls 106 which extend beyond the top portion 102 of return reach 61 to bottom wall 51 of crossover portion 92. Conveying reach 59 includes horizontal bottom portion 100 extending below track 107 and spaced flights 62 connecting to vertically extending side walls 110. Vertical side walls 110 extend below bottom portion 100 of conveying reach 59 to top wall 49 of cross-over portion 92. Vertical side walls 110 and vertical side walls 106 wedge in top wall 49 and bottom wall 51 of cross-over portion 92 of second duct assembly 90, respectively, to provide stability for cross-over portion 92 of second duct assembly 90 while mobile frame assembly 12 is in all modes of operation.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A continuous miner comprising, a mobile frame assembly having a front end portion, a rear end portion, a first side portion and a second side portion, a boom assembly having a hollow interior portion extending from said mobile frame assembly, said boom assembly having a first end portion pivotally connected to said mobile frame assembly by a plurality of connecting means and a second end portion spaced from said first end portion, dislodging means connected to said boom assembly second end portion, conveying means extending longitudinally along said mobile frame assembly, said conveying means having a conveying reach and a return reach below said conveying reach, said conveying means mounted on said mobile frame assembly for receiving and conveying material from said dislodging means, dust collecting means including a fan assembly and first and second duct assemblies positioned on a first side portion of said mobile frame assembly for inducing a flow of air through said boom assembly hollow interior portion, said fan assembly positioned on said mobile frame assembly at said mobile frame assembly rear end portion, said first duct assembly extending longitudinally along said first side portion of said mobile frame assembly, said first duct assembly having an end portion connected with said fan assembly and an opposite end portion, said second duct assembly extending partially along said second side portion of said mobile frame assembly, said second duct assembly having an end portion connected with said first duct assembly, an opposite end portion and a crossover portion extending across said mobile frame assembly and said conveying means, said first duct assembly opposite end portion and said second duct assembly opposite end portion being in fluid communication with said boom assembly hollow interior portion in all positions of said boom assembly.

2. A continuous miner as set forth in claim 1 in which, said conveying means conveying reach is positioned above said return reach, said second duct assembly crossover portion extending below said conveying means conveying reach.

3. A continuous miner as set forth in claim 2 in which, said conveying means includes a bottom wall positioned below said conveying reach, a portion of said conveying means bottom wall forming the upper wall of said crossover portion of said second duct assembly.

4. A continuous miner as set forth in claim 1 in which, said first and second duct assemblies each having a pair of vertically extending side walls spaced from each other and a pair of horizontally extending top and bottom walls connected between said vertically extending side walls.

5. A continuous miner as set forth in claim 1 in which, said first and second duct assembly opposite end portions each terminate in an arcuate wall having an air inlet formed therein, said boom assembly having top and bottom walls in sliding contact with said first and second duct assembly arcuate walls so that said boom assembly hollow interior portion remains in fluid communication with said first and second duct assemblies in all positions of said boom assembly.

* * * * *